US010168036B2

(12) United States Patent
Wang et al.

(10) Patent No.: US 10,168,036 B2
(45) Date of Patent: Jan. 1, 2019

(54) BAR-TYPED TRACK LED LAMP

(71) Applicant: Wanjiong Lin, Ningbo (CN)

(72) Inventors: Dingyi Wang, Ningbo (CN); Taolin Zhu, Ningbo (CN)

(73) Assignee: Self Elecronics Co., Ltd., Ningbo (CN)

( * ) Notice: Subject to any disclaimer, the term of this patent is extended or adjusted under 35 U.S.C. 154(b) by 440 days.

(21) Appl. No.: 14/586,687

(22) Filed: Dec. 30, 2014

(65) Prior Publication Data

US 2015/0338037 A1 Nov. 26, 2015

(30) Foreign Application Priority Data

May 26, 2014 (CN) ..... 2014 1 0223976

(51) Int. Cl.

| | |
|---|---|
| ***F21V 21/34*** | (2006.01) |
| ***F21V 21/35*** | (2006.01) |
| ***F21S 4/28*** | (2016.01) |
| *F21S 8/06* | (2006.01) |
| *F21Y 103/10* | (2016.01) |
| *F21Y 115/10* | (2016.01) |

(52) U.S. Cl.

CPC ..... *F21V 21/34* (2013.01); *F21S 4/28* (2016.01); *F21V 21/35* (2013.01); *F21S 8/066* (2013.01); *F21Y 2103/10* (2016.08); *F21Y 2115/10* (2016.08)

(58) Field of Classification Search

CPC ... F21S 4/008; F21S 4/28; F21S 8/066; F21V 21/34; F21V 21/35; F21V 23/06; F21Y 2103/10; F21Y 2115/10; F21Y 2105/00; F21Y 2115/15; H05B 33/08; H01L 2251/5361

See application file for complete search history.

(56) References Cited

U.S. PATENT DOCUMENTS

| | | | | |
|---|---|---|---|---|
| 4,190,309 | A * | 2/1980 | Glass | H01R 25/142 439/118 |
| 2002/0064049 | A1* | 5/2002 | Layne | F21V 17/164 362/404 |
| 2006/0245186 | A1* | 11/2006 | Stillman | F21L 14/026 362/225 |
| 2014/0111094 | A1* | 4/2014 | Kodama | H05B 33/08 315/129 |

(Continued)

*Primary Examiner* — Anh T Mai
*Assistant Examiner* — Fatima N Farokhrooz
(74) *Attorney, Agent, or Firm* — Wang Law Firm, Inc.

(57) ABSTRACT

A bar-typed track LED lamp includes a track, a bar-typed LED lamp movably mounted on the track, a connector disposed between the track and the bar-typed LED lamp, and two balance mechanisms disposed on the bar-typed LED lamp and arranged at both sides of the connector along a longitudinal direction of the track. Each of the two balance mechanisms includes a housing disposed on the bar-typed LED lamp, a prop received in the housing and protruding from the housing, and at least one elastic member arranged between the prop and the bar-typed LED lamp. The prop presses against the track while the elastic member is under compression. Whether the direction of the tension force F is strictly coincide with the center of gravity of the bar-typed LED lamp or not, the bar-typed LED lamp always receives an equal moment. Therefore, the connecter or the bar-typed LED cannot be damaged.

9 Claims, 3 Drawing Sheets

(56) References Cited

U.S. PATENT DOCUMENTS

2014/0226325 A1* 8/2014 Allen ..... F21V 21/088
362/231
2014/0369061 A1* 12/2014 Kim ..... F21S 2/00
362/543

* cited by examiner

BAR-TYPED TRACK LED LAMP

RELATED APPLICATION

The present application claims benefit of the Chinese Application, CN201410223976.5, filed on May 26, 2014.

BACKGROUND

1. Technical Field

The disclosure relates to lighting devices, and more particularly to a bar-typed track LED lamp.

2. Description of the Related Art

With development of LED lighting devices, various LED lamps are used in different scenes for satisfying different requirements. As a bar-typed track lamp can move along a track so as to adjust lighting range and it is easy to design, the bar-typed track lamp is quickly put into use in a wider scope. In the prior art, the bar-typed track lamp is connected to the track via a connecting mechanism which is arranged in middle thereof. However, the line between the force point of the connecting mechanism and the center of gravity of the bar-typed track lamp is not perpendicular to the longitudinal axis of the bar-typed track lamp due to assembling error which cannot be avoided. Therefore, a torsion moment is formed on the bar-typed track lamp. In a result, the bar-typed track lamp may rotate around the connecting mechanism. The rotation of the bar-typed track lamp not only affects illumination performance thereof, but also may damage the connection mechanism as the end of the bar-typed track lamp presses the connection mechanism and another end fractures it.

The above information disclosed in this section is only for enhancement of understanding of the background of the invention and therefore it may contain information that does not form the prior art that is already known in this country to a person of ordinary skill in the art.

BRIEF DESCRIPTION OF THE DRAWINGS

Many aspects of the embodiments can be better understood with references to the following drawings. The components in the drawings are not necessarily drawn to scale, the emphasis instead being placed upon clearly illustrating the principles of the embodiments. Moreover, in the drawings, like reference numerals designate corresponding parts throughout three views.

DETAILED DESCRIPTION

The disclosure is illustrated by way of example and not by way of limitation in the figures of the accompanying drawings. It should be noted that references to "an" or "one" embodiment in this disclosure are not necessarily to the same embodiment, and such references mean at least one.

Figure 1:
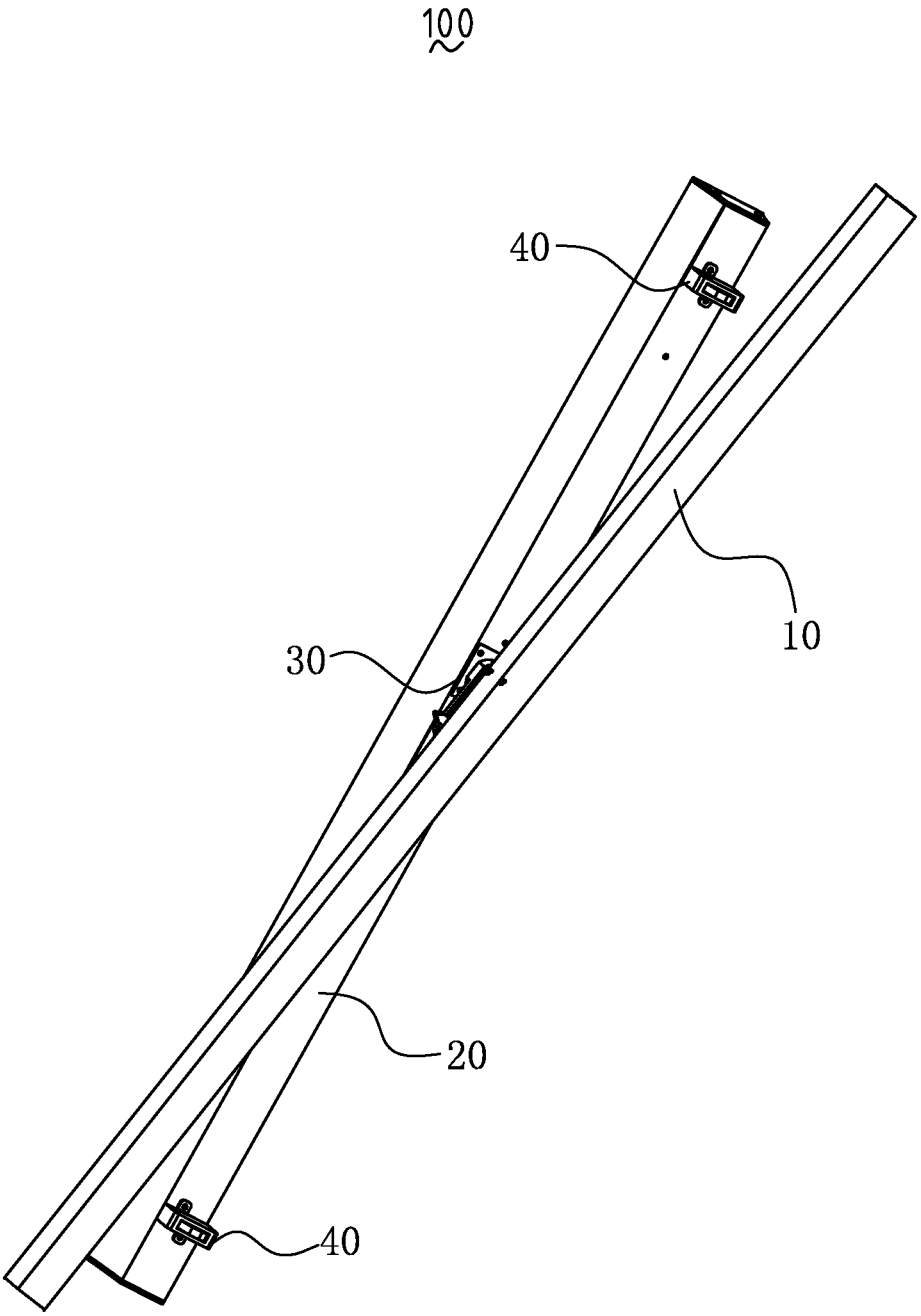
FIG. 1 is an isometric view of a bar-typed track LED lamp according to an embodiment.
Figure 2:
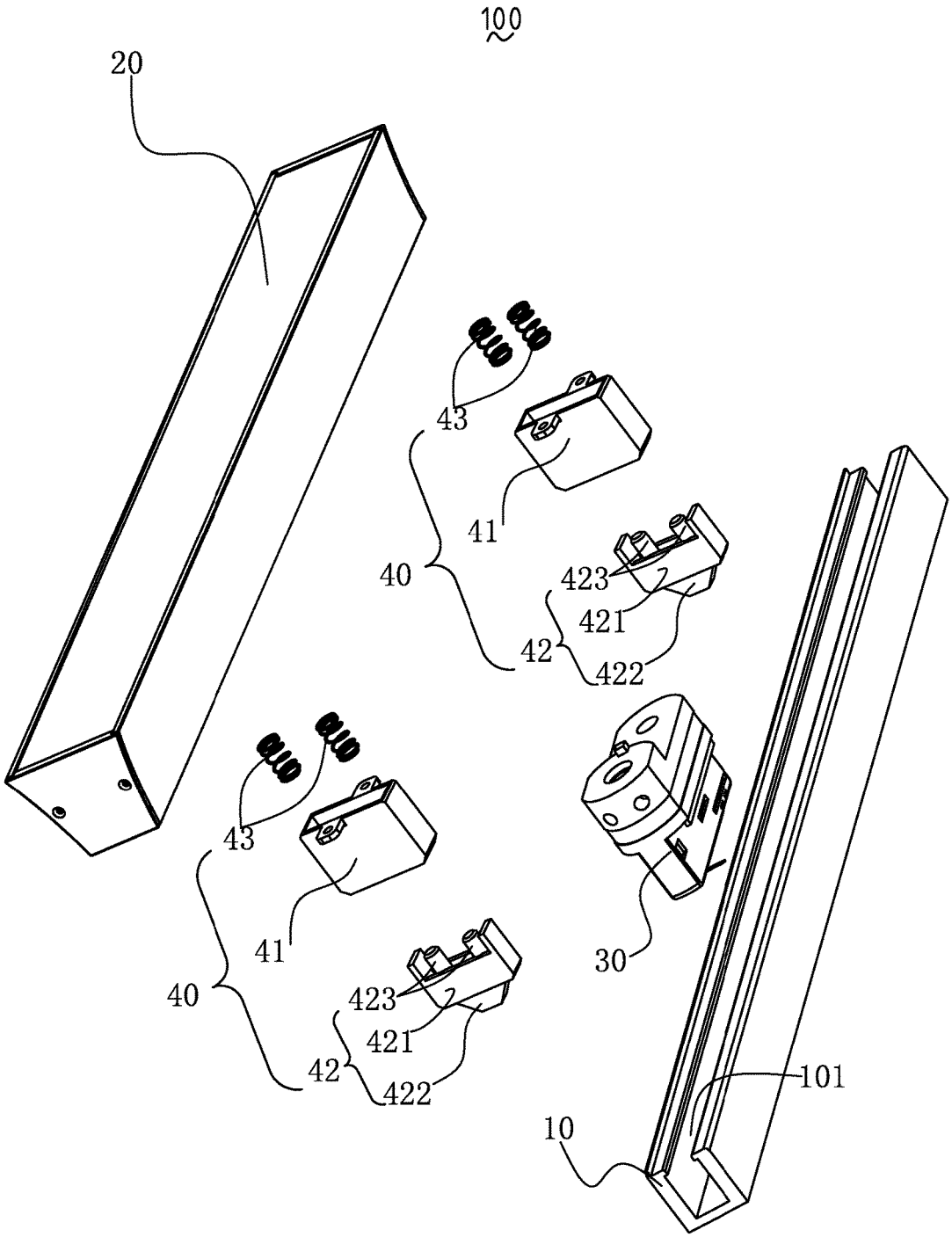
FIG. 2 is an explosive view of the bar-typed track LED lamp of FIG. 1

Referring to FIG. 1 and FIG. 2, a bar-typed track LED lamp 100 is shown. The bar-typed track LED lamp 100 includes a track 10, a bar-typed LED lamp 20 movably mounted on the track 10, a connector 30 disposed between the track 10 and the bar-typed LED lamp 20, and two balance mechanisms 40 disposed on the bar-typed LED lamp 20 and arranged at both sides of the connector 30 along a longitudinal direction of the track 10. As is well known for a person skilled in the art, the bar-typed track LED lamp 100 further includes other function components, such as power, wires, and so on, which need not to be described in detail.

The track 10 may be made of plastic or metal and is assembled along the longitudinal direction thereof. In the present embodiment, the track 10 is made of aluminum and has U-shaped cross section. The track 10 includes a slot 101. The slot 101 includes two flanges extending a direction perpendicular to the longitudinal direction of the track 10 for mounting the connector 30. Moreover, the track 10 includes power wires for the bar-typed LED lamp 20.

The bar-typed LED lamp 20 includes an elongated shell, and other components received in the elongated shell. The components may be PCB, at least one LED chip disposed on the PCB, lens, cover, and so on. The bar-typed LED lamp 20 is assembled onto the track 10 via the connector 30.

The connector 30 has one rotatable end which is fixed onto the bar-typed LED lamp 20 and has another movable end which is inserted into the slot 101 so as to connect the bar-typed LED lamp 20 and the track 10. The connector 30 includes two contact terminals which electrically touch with power wires for supplying power to the bar-typed LED lamp 20.

The two balance mechanisms 40 are respectively arranged at both sides of the connector 30 so as to achieve a moment balance for the bar-typed LED lamp 20. The distance between one of the two balance mechanisms 40 and the connector 30 may be identical with or not equal to that between another and the connector 30. Understandably, when the two balance mechanisms 40 locate in different positions, the two ends of the bar-typed LED lamp 20 will be subject to the different forces of gravity. However, the counterforce provided by the two balance mechanisms 40 respectively could vary with the different forces of gravity. As a result, the bar-typed LED lamp 20 can achieve a equilibrium. Each of the two balance mechanisms 40 includes a housing 41 disposed on the bar-typed LED lamp 20, a prop 42 received in the housing 41 and protruding from the housing 41, and at least one elastic member 43 arranged between the prop 42 and the bar-typed LED lamp 20.

The housing 41 may be made of various materials and has a tubular hollow configuration which has two openings along longitudinal direction thereof. The tubular housing 41 has a section of circular, quadrangle, or irregular shape. A section area of one of the two openings along a direction vertical to the longitudinal direction of the housing 41 is less than that of another, and the prop 42 protrudes from the opening having the less section area. The another end of the housing 41, which has the larger section area, is fixed onto the bar-typed LED lamp 20 by various method, such as welding, riveting, and so on. Also, the another end of the housing 41 has a flange disposed thereon and on which at least one hole is opened for fixing the housing 41 by fasteners.

The prop 42 includes a body 421, a tip 422 disposed on one end of the body 421, and at least one installation member 423 disposed on another end of the body 421. The body 421 is received into the housing 41 and may have various shapes as long as it can be inserted into the housing 41 from the larger opening thereof and not divorced from another smaller opening thereof. In the present embodiment, the body 421 and the housing 41 have a rectangular section along the direction vertical to the longitudinal direction of the housing 41. The body 421 includes two guide plates extending therefrom along the direction vertical to the longitudinal direction of the housing 41. The two guide plates fit closely with the inner wall of the housing 41 for limiting the moving direction of the prop 42. The tip 422 presses against the slot 101 and has a various shape. In the present embodiment, the tip 422 has a trapezoid section along a direction which is parallel to a pressing direction thereof and vertical to the longitudinal direction of the track 10 for matching with different track 10 which has different width of the slot 101. The tip 422 has a smaller cross sectional area than that of the body 421 along the direction vertical to the longitudinal direction of the housing 41 so as to prevent the body 421 from protruding from the opening of the housing 41 which has the smaller cross sectional area. Therefore, the body 421 is clamped between the opening and the elastic member 43. For disposing the elastic member 43, the installation member 423 is disposed on another end of the body 421 and is a cylinder. In the present embodiment, the prop 42 includes two installation members 423.

The elastic member 43 may be a coil spring, or a belleville spring. In the present embodiment, the elastic member 43 is the coil spring and wrapped onto the installation member 423. The balance mechanism 40 includes two elastic members 43. The prop 42 presses against the track 10 while the elastic member 43 is under compression for providing counterforce against the gravity.

Figure 3:
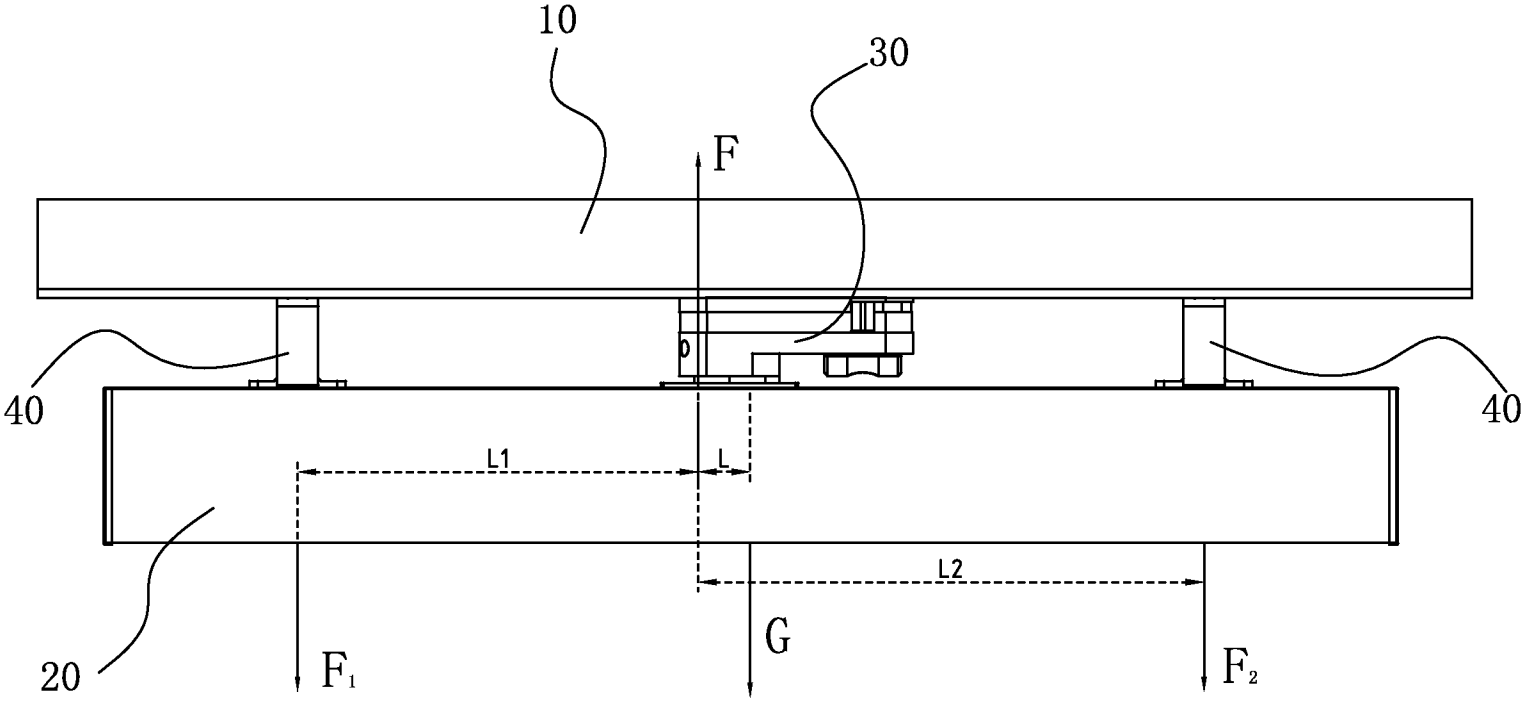
FIG. 3 is a mechanics analysis diagram of the bar-typed track LED lamp of FIG. 1.

Referring to FIG. 3, after assembling the bar-typed track LED lamp 100, the bar-typed LED lamp 20 is subjected to three forces which includes two elastic forces F1, F2 from the balance mechanism 40 and a gravity G. The resultant force of the three forces F1, F2, and G is equal to the tension force F from the connector 30 while the direction of the tension force F strictly coincides with the center of gravity of the bar-typed LED lamp 20. As a result, the bar-typed LED lamp 20 receives an equal moment. When the direction of the tension force F is located on the left side of the center of gravity of the bar-typed LED lamp 20, that is to say, when the distance L2 between the elastic force F2 and the tension force F is less than the distance L1 between the elastic force F1 and the tension force F, $G*L+F2*L2=F1*L1$, wherein L is the distance between the center of gravity and the connector 30. Because of the elastic member 43, the elastic force F1 is less than the elastic force F2 and amount of compression of one elastic member 43 is less than that of another, or vice versa. As a result, whether the direction of the tension force F strictly coincides with the center of gravity of the bar-typed LED lamp 20 or not, the bar-typed LED lamp 20 always receives an equal moment. Therefore, the bar-typed LED lamp 20 may not rotate around the connector 30 and the connecter 30 or the bar-typed LED lamp 20 cannot be damaged as the end of the bar-typed LED lamp 20 presses the connector 30 and another end fractures it.

While the disclosure has been described by way of example and in terms of exemplary embodiment, it is to be understood that the disclosure is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A bar-typed track LED lamp comprising:

a track, a bar-typed LED lamp movably mounted on the track, a connector disposed between the track and the bar-typed LED lamp, the connector having a rotatable end fixed onto the bar-typed LED lamp and a movable end fixed to the track, and two balance mechanisms connected to the bar-typed LED lamp and arranged on opposite sides of the connector along a longitudinal direction of the track, a distance between one of the two balance mechanisms and the connector being not equal to that between the other balance mechanism and the connector, each of the two balance mechanisms comprising a housing disposed on the bar-typed LED lamp, a prop received in the housing and protruding from the housing, and at least one elastic member arranged between the prop and the bar-typed LED lamp, the prop pressing against the track while the elastic member is under compression, wherein when the two balance mechanisms are not disposed equidistantly from the connector, two ends of the bar-typed LED lamp are subject to different forces of gravity, a counterforce provided by the two balance mechanisms respectively varies with the different forces of gravity so that the bar-typed LED lamp maintains equilibrium.

2. The bar-typed track LED lamp of claim 1, wherein the housing has a tubular configuration which has two openings along longitudinal direction thereof, a cross section area of one of the two opening along a direction vertical to the longitudinal direction of the housing is less than that of another, the prop protrudes from the opening of the housing which has the smaller cross section area.

3. The bar-typed track LED lamp of claim 1, wherein the distance between one of the two balance mechanisms and the connector are identical with that between another and the connector.

4. The bar-typed track LED lamp of claim 1, wherein the distance between one of the two balance mechanisms and the connector is not equal to that between another and the connector.

5. The bar-typed track LED lamp of claim 2, wherein the prop comprises a body, a tip disposed on the body, the tip protrudes from the opening of the housing which has the smaller cross section area.

6. The bar-typed track LED lamp of claim 5, wherein the tip has a smaller cross section area than that of the body along a direction vertical to the longitudinal direction of the housing so as to prevent the body from protruding from the opening of the housing which has the smaller cross section area.

7. The bar-typed track LED lamp of claim 5, wherein the elastic member is a coil spring, the prop further comprises an installation member for disposing the elastic member.

8. The bar-typed track LED lamp of claim 5, wherein each of the two balance mechanisms comprises two elastic members, the elastic member is a coil spring, the prop further comprises two installation members for disposing the two elastic member respectively.

9. The bar-typed track LED lamp of claim 5, wherein the tip has a trapezoid section along a direction which parallel to a pressing direction thereof and vertical to the longitudinal direction of the track for matching with different track.

* * * * *